US009764939B2

(12) United States Patent
Brunnert et al.

(10) Patent No.: US 9,764,939 B2
(45) Date of Patent: Sep. 19, 2017

(54) METHOD OF MAKING STRINGS OF POCKETED SPRINGS

(71) Applicant: L&P Property Management Company, South Gate, CA (US)

(72) Inventors: John J. Brunnert, Carthage, MO (US); John E. Hull, Monett, MO (US); Richard A. Krtek, Miller, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 305 days.

(21) Appl. No.: 14/629,580

(22) Filed: Feb. 24, 2015

(65) Prior Publication Data

US 2015/0239730 A1 Aug. 27, 2015

Related U.S. Application Data

(60) Provisional application No. 61/944,779, filed on Feb. 26, 2014.

(51) Int. Cl.

| | |
|---|---|
| ***D06C 23/00*** | (2006.01) |
| ***B68G 7/00*** | (2006.01) |
| ***B26F 1/24*** | (2006.01) |
| ***B68G 9/00*** | (2006.01) |

(52) U.S. Cl.

CPC ..... *B68G 9/00* (2013.01); *B26F 1/24* (2013.01); *B68G 7/00* (2013.01); *D06C 23/00* (2013.01); *Y10T 29/49613* (2015.01)

(58) Field of Classification Search

CPC ..... Y10T 83/483; Y10T 83/4833; Y10T 83/4836; Y10T 83/4838; Y10T 83/4841; Y10T 83/4844; Y10T 83/9408; Y10T 29/48; Y10T 29/481; Y10T 29/487; Y10T 83/9314; Y10T 83/0481; D06C 15/00; D06C 15/02; D06C 15/08; D06C 23/00; D06C 23/04

USPC ..... 29/91, 91.1, 91.6; 83/30, 660, 346, 678, 83/343; 28/163, 170

See application file for complete search history.

(56) References Cited

U.S. PATENT DOCUMENTS

| | | | | | |
|---|---|---|---|---|---|
| 2,757,372 | A * | 7/1956 | Chambon | B44C 1/24 | 101/23 |
| 3,635,625 | A * | 1/1972 | Voss | D06C 3/04 | 26/2 R |
| 3,657,857 | A * | 4/1972 | De Woskin | B65B 11/50 | 206/463 |
| 3,785,016 | A * | 1/1974 | Hergert | D06C 3/00 | 26/16 |
| 3,850,095 | A * | 11/1974 | Snyder | D06B 11/0066 | 101/25 |

(Continued)

*Primary Examiner* — Sarang Afzali
*Assistant Examiner* — Darrell C Ford
(74) *Attorney, Agent, or Firm* — Wood, Herron & Evans, LLP

(57) ABSTRACT

An apparatus for ventilating a web of material used in the manufacture of pocketed springs may be removably attached to a pocket coiler. The apparatus has an upper movable portion which pivots relative to a stationary portion. The stationary portion may be removably attached to the pocket coiler. Each portion has at least one roller, a web of material passing between the rollers during use. One of the rollers may have protrusions to create openings in the material before the material enters the pocket coiler.

19 Claims, 17 Drawing Sheets

(56) References Cited

U.S. PATENT DOCUMENTS 3,997,946 A * 12/1976 Hergert ..... D06C 3/04 26/2 R
4,045,135 A * 8/1977 Doi ..... G03G 15/104 271/900
4,167,131 A 9/1979 Habas et al.
4,223,063 A * 9/1980 Sabee ..... B29C 55/18 28/100
4,401,501 A * 8/1983 Stumpf ..... B68G 9/00 156/182
4,682,540 A * 7/1987 Eastman ..... B29C 59/04 101/28
4,854,023 A 8/1989 Stumpf
5,386,752 A 2/1995 Siegel
6,175,997 B1 1/2001 Mossbeck
6,257,133 B1 * 7/2001 Anderson ..... D21F 3/06 100/155 R
6,295,673 B1 * 10/2001 Mossbeck ..... A47C 27/064 5/655.8
6,574,811 B1 * 6/2003 Mossbeck ..... A47C 27/064 5/655.8
7,426,886 B2 * 9/2008 Spatafora ..... B31F 1/07 101/23
2001/0042360 A1 11/2001 Santis et al.
2005/0217091 A1 * 10/2005 Muth ..... B26F 1/24 28/106
2006/0219314 A1 * 10/2006 Bertram ..... B29C 44/588 141/10
2009/0056286 A1 * 3/2009 Bertram ..... B29C 44/60 53/505
2009/0205471 A1 8/2009 Boyer, Jr.
2009/0209156 A1 * 8/2009 Pedoja ..... D04H 1/4258 442/327
2014/0104360 A1 * 4/2014 Hacker ..... B41J 3/60 347/104
2015/0239730 A1 * 8/2015 Brunnert ..... B68G 9/00 29/896.92
2017/0182673 A1 * 6/2017 Brunnert ..... B68G 9/00

* cited by examiner

METHOD OF MAKING STRINGS OF POCKETED SPRINGS

CROSS-REFERENCE TO RELATED APPLICATIONS

This application claims the benefit of U.S. Provisional Patent Application Ser. No. 61/944,779 filed Feb. 26, 2014, which is fully incorporated by reference herein.

BACKGROUND OF THE INVENTION

This invention relates generally to an apparatus for use in a conventional pocket coil machine which is capable of making a continuous string of pocketed springs having ventilation holes. The invention further relates to the method of manufacturing such strings of pocketed springs.

Pocketed spring assemblies or cores are commonly used in bedding or seating products. Such pocketed spring cores are commonly made from strings of individually pocketed springs joined together. Multiple strings of springs of the same length may be welded or otherwise secured together. The height of the individual strings of pocketed springs may be identical or vary in a pocketed spring core or assembly.

Existing pocket coil machines which produce continuous strings of individually pocketed springs use a non-woven web of fabric which has natural ventilation, but no additional openings for ventilation. Many different manufacturers of pocketed spring assemblies use the same fabric. Therefore, when viewing a bedding or seating product incorporating an assembly or array of such strings of pocketed springs, it may be difficult to identify the manufacturer or source of the pocketed spring assembly.

In order to identify the source or manufacturer of a pocketed spring product, it would be useful to create a pattern of openings or ventilation holes in the form of letters or numbers in the fabric of one or more individual pockets.

Further, it would be desirable to use a conventional fabric in a pocket coil machine and be able to create openings in the fabric for ventilation before the individual springs are encased in such fabric, as opposed to using a pre-ventilated fabric, for cost savings.

Therefore, an apparatus capable of use with existing pocket coil machines which ventilates the material used for the pockets would be desirable. An apparatus which could pattern the ventilation holes in patterns to identify the product or the manufacturer of the strings of pocketed springs would be an additional benefit.

SUMMARY OF THE INVENTION

According to one aspect of this invention, an apparatus for creating ventilation openings in fabric used to create a continuous string of pocketed springs is provided. A portion of the ventilation apparatus may be removably secured to a pocket coil machine to treat or ventilate the fabric prior to the fabric entering the pocket coil machine. The pocket coil machine may be any known in the industry. The fabric may be any type of fabric. The present invention is not intended to limit or restrict in any manner the pocket coil machine with which any embodiment of ventilation apparatus in accordance with the present invention may be used. The present invention is further not intended to limit or restrict in any manner the type of fabric which may be used in any embodiment of ventilation apparatus shown or described herein.

The ventilation apparatus comprises two principal portions: a stationary portion and a movable portion. The stationary portion or brush roller assembly may be removably secured or attached to the pocket coil machine. The movable portion or pin roller assembly is removably secured to the stationary portion in such a manner that the movable portion may pivot relative to the stationary portion of the ventilation apparatus between fully open, fully closed and intermediate positions.

The brush roller assembly of the ventilation apparatus comprises a stationary frame having two sides. The stationary frame has an opening in a middle portion between the side portions. The brush roller assembly of the ventilation apparatus further comprises a rotatable brush roller shaft extending between the sides of the stationary frame. At least one brush roller is mounted on the brush roller shaft. Friction between the moving fabric and the brush roller(s) causes rotation of the brush roller(s) and brush roller shaft. The brush roller assembly of the ventilation apparatus may further comprise guide rollers extending between the stationary frame sides to guide the web of material into and out of the ventilation apparatus.

The pin roller assembly of the ventilation apparatus comprises two opposed frame members joined together by at least one support member. Each of the frame members of the pin roller assembly of the ventilation apparatus is pivotally secured to a side of the brush roller assembly of the ventilation apparatus. A rotatable pin roller shaft extends between the movable frame members. At least one pin roller is mounted on the pin roller shaft. The pin roller shaft may be driven any number of ways, including a motorized drive assembly.

According to another aspect of this invention, a method of making a continuous string of pocketed springs is provided. The method comprises passing a web of material between two rollers, at least one of the rollers having protrusions to create a patterned web. The patterned web has multiple patterns of openings in the web. The next step in the process comprises introducing the patterned web into a pocket coil machine for creating a string of individually pocketed springs.

Another method of making a continuous string of pocketed springs comprises passing a web of material between rollers to create a patterned web, at least one of the rollers having pins and at least one of the rollers being a brush roller. The patterned web has openings through the web. The last step comprises introducing the patterned web into an apparatus, such as a pocket coil machine, for creating a string of individually pocketed springs.

One advantage of this invention is that it enables an existing pocket coiler to be quickly and easily retrofitted with a ventilation apparatus to improve the ventilation of the individually pocketed coil springs exiting the pocket coiler.

Another advantage of this invention is that it enables a pattern to be quickly and/or inexpensively imprinted on individually pocketed coil springs to improve the ventilation of the individually pocketed coil springs or identify the product or source of a pocketed product to a customer.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
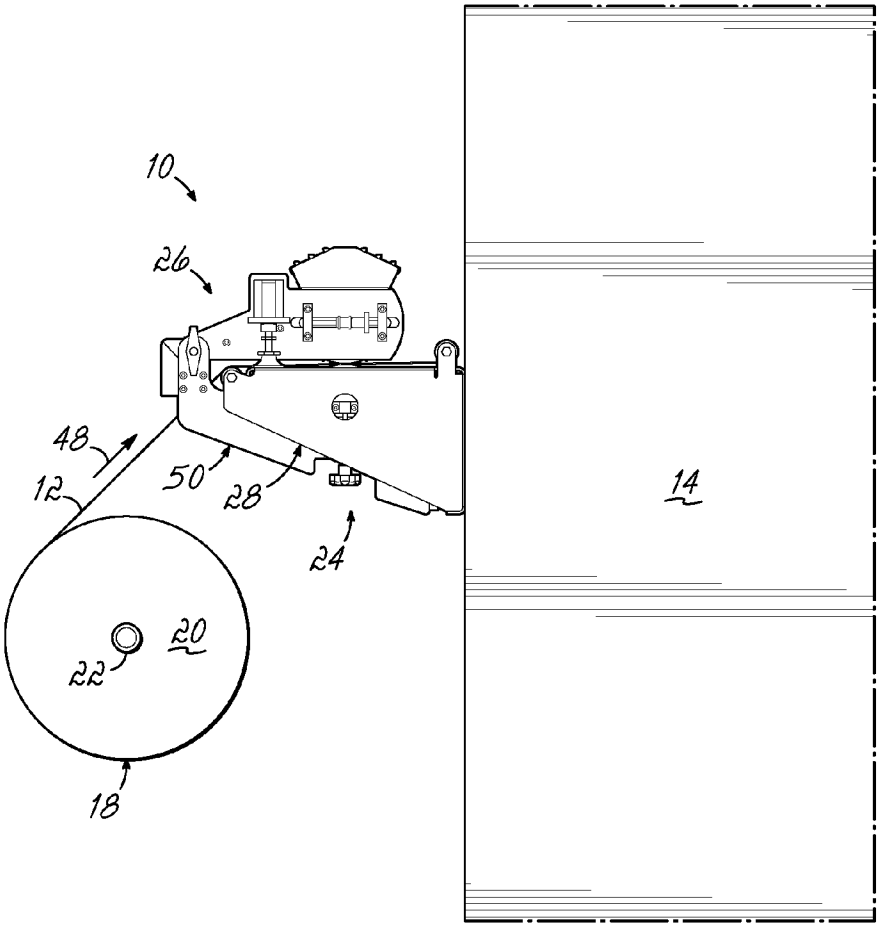
FIG. 1 is a side elevational view of the ventilation apparatus according to one embodiment of the invention attached to a pocket coil machine and being utilized to ventilate the fabric used in the pocket coil machine.

Referring to the drawings, and particularly to FIG. 1, a ventilation apparatus 10 used for ventilating a web of material 12, according to one embodiment of this invention, is illustrated. As shown in FIG. 1, the ventilation apparatus 10 is attached to a pocket coil machine 14. The ventilation apparatus 10 may be attached to any pocket coil machine, including one sold by Spuhl AG and sold as Model P-450. However, the ventilation apparatus 10 may be used with any pocket coil machine and does not have to be directly attached to the pocket coil machine. This document does not intend to limit in any fashion the type of pocket coil machine with which the ventilation apparatus 10 may be used.

Figure 2:
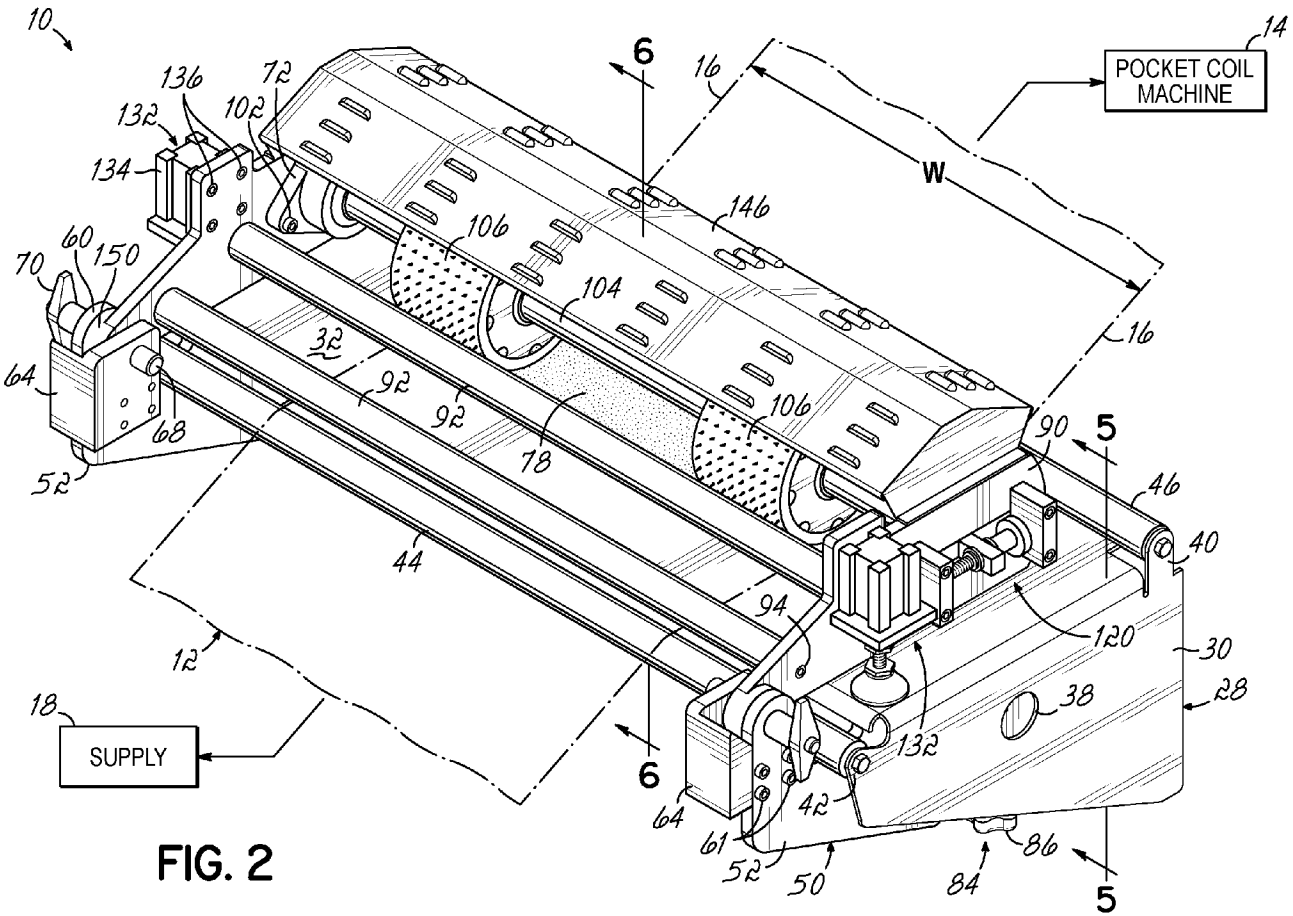
FIG. 2 is a perspective view of the ventilation apparatus of FIG. 1.

As shown in FIG. 2, the web of material 12 is illustrated having two side edges 16 defining a width "W". Although one width is shown, the web of material 12 may have any desired width and is not intended to be limited by the drawings. As shown in FIGS. 1 and 2, the web of material 12 originates from a supply 18, passes through the ventilating apparatus 10 and enters the pocket coil machine 14. One supply illustrated in FIG. 1 may be a roll of fabric 20 mounted on a rotatable axle 22. However, any other supply may be used.

Figure 8:
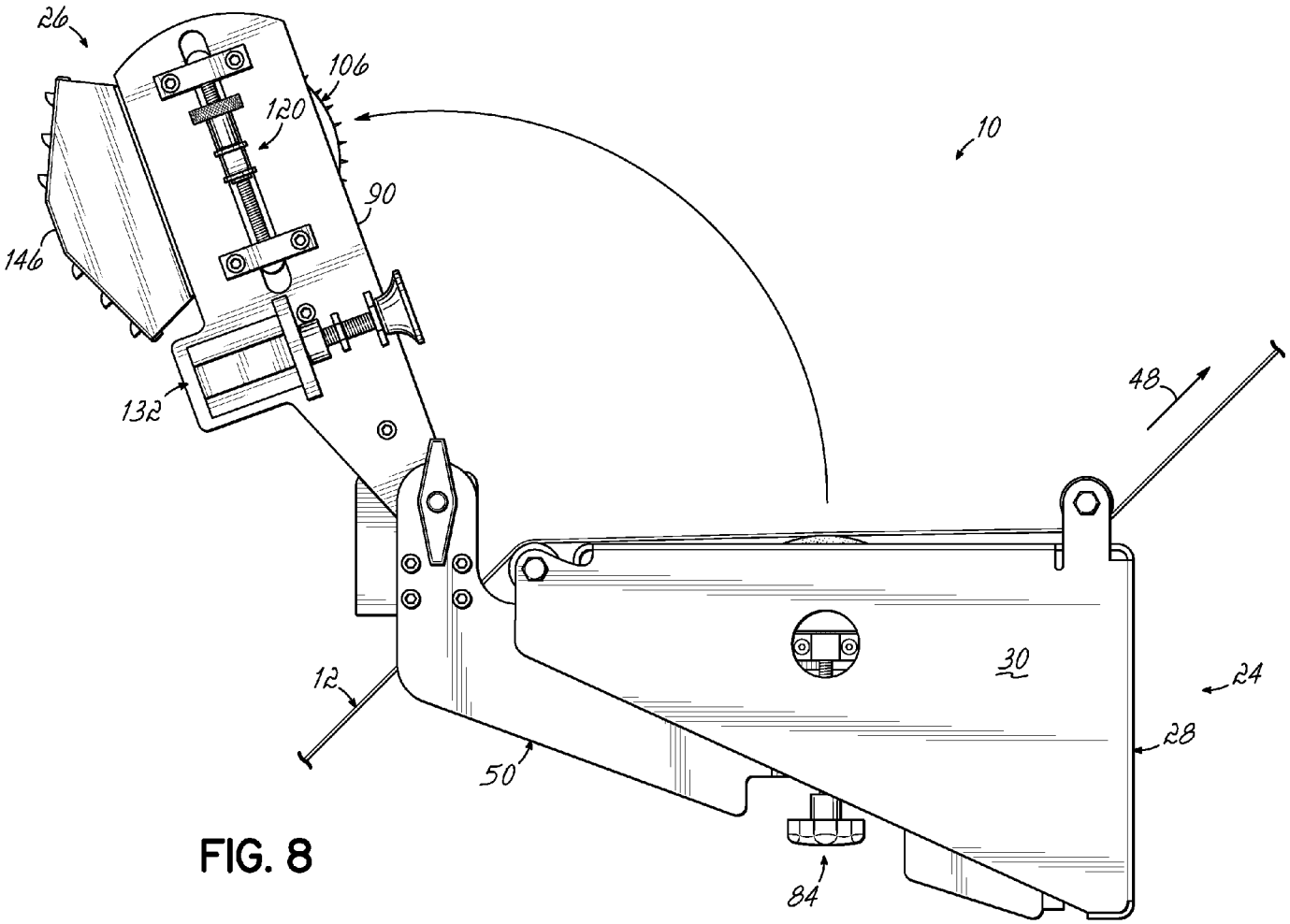
FIG. 8 is a side elevational view illustrating the ventilation apparatus of FIG. 2 in an open position.

As best shown in FIG. 8, the ventilating apparatus 10 has a stationary portion or brush roller assembly 24 and a movable portion or pin roller assembly 26 which is pivotal between a closed position shown in FIGS. 1-6 and an open position shown in FIG. 8. The ventilating apparatus 10 and, more specifically, the brush roller assembly 24 may be removably attached to the pocket coil machine 14 in any desired manner. See FIG. 1. Alternatively, ventilating apparatus 10 may stand on its own a distance from a pocket coil machine.

Although not illustrated, it is within the contemplation of the present invention that one or more pin rollers mounted on a pin roller shaft be part of the stationary portion of the ventilating apparatus and the brush roller(s) and shaft be part of the pivotal portion of the ventilating apparatus. Either the pin roller shaft or the brush roller shaft may be driven by a drive apparatus not limited to the one illustrated and described herein. For example, a servo motor may be used to rotate either the shaft on which one or more pin rollers are mounted and/or the shaft on which one or more brush rollers are mounted, regardless of whether the roller(s) are part of the stationary or movable portion of the ventilating apparatus.

Figure 3:
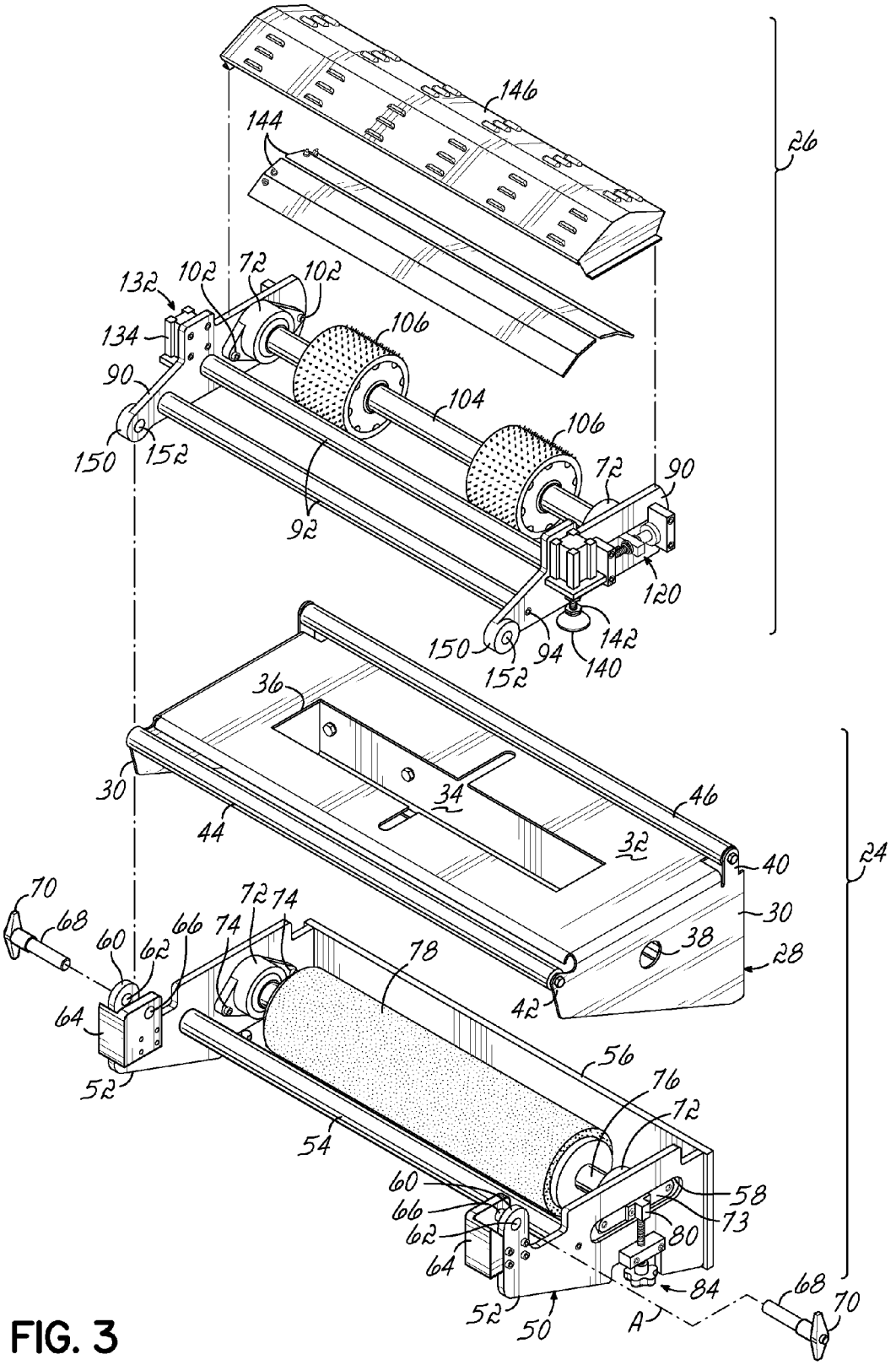
FIG. 3 is a partially disassembled view of the ventilation apparatus of FIG. 1.
Figure 4:
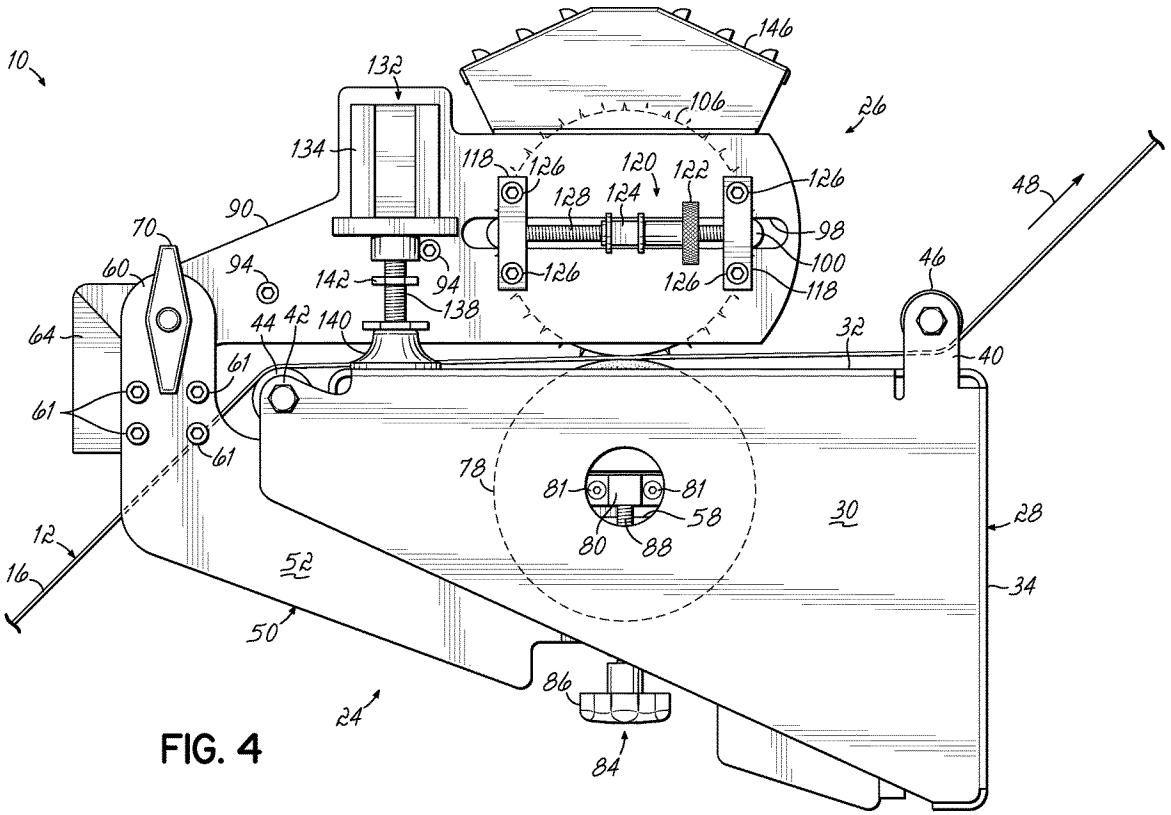
FIG. 4 is a side elevational view of the ventilation apparatus of FIG. 1.
Figure 5:
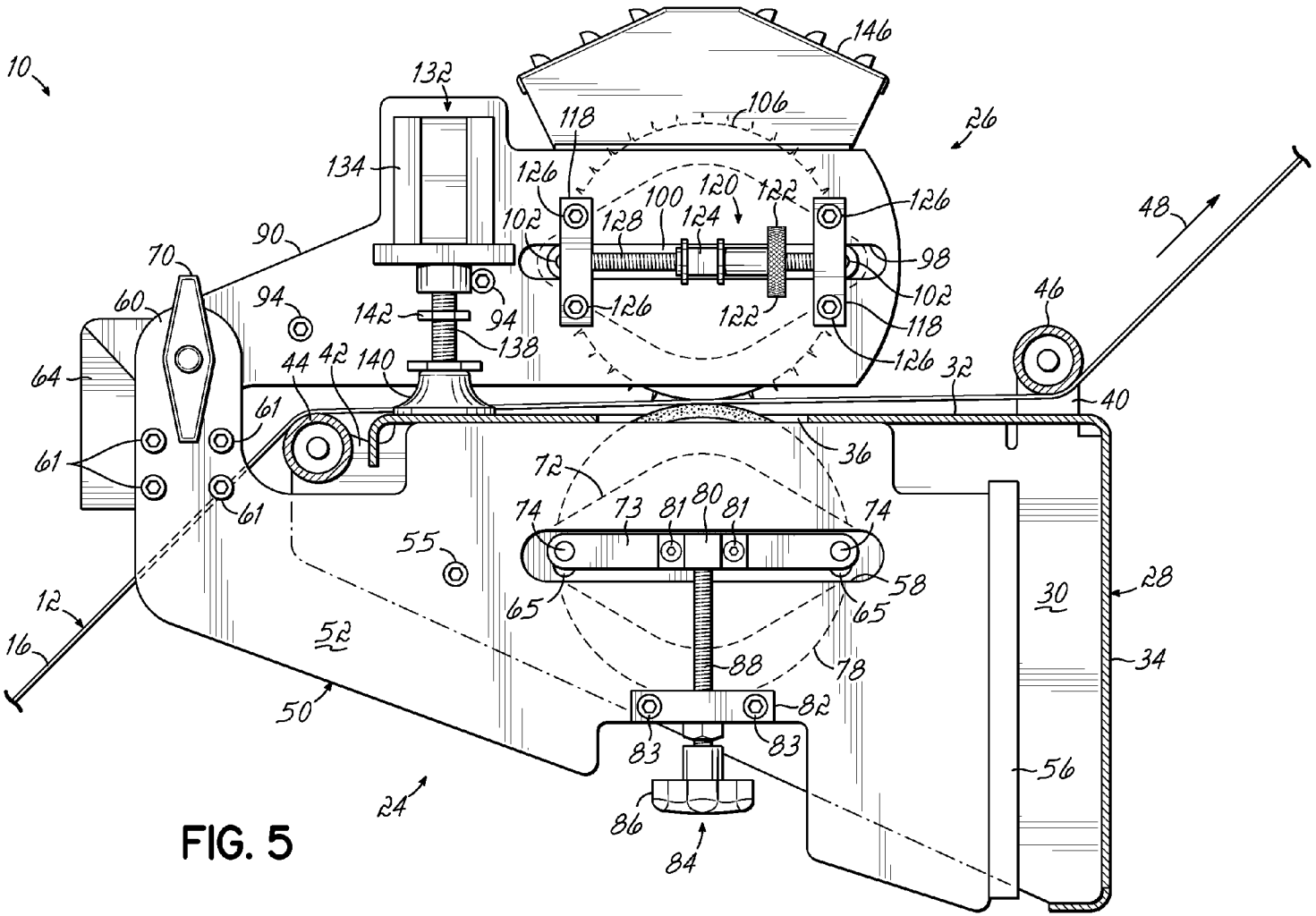
FIG. 5 is taken along the line 5-5 of the ventilation apparatus of FIG. 2.
Figure 6:
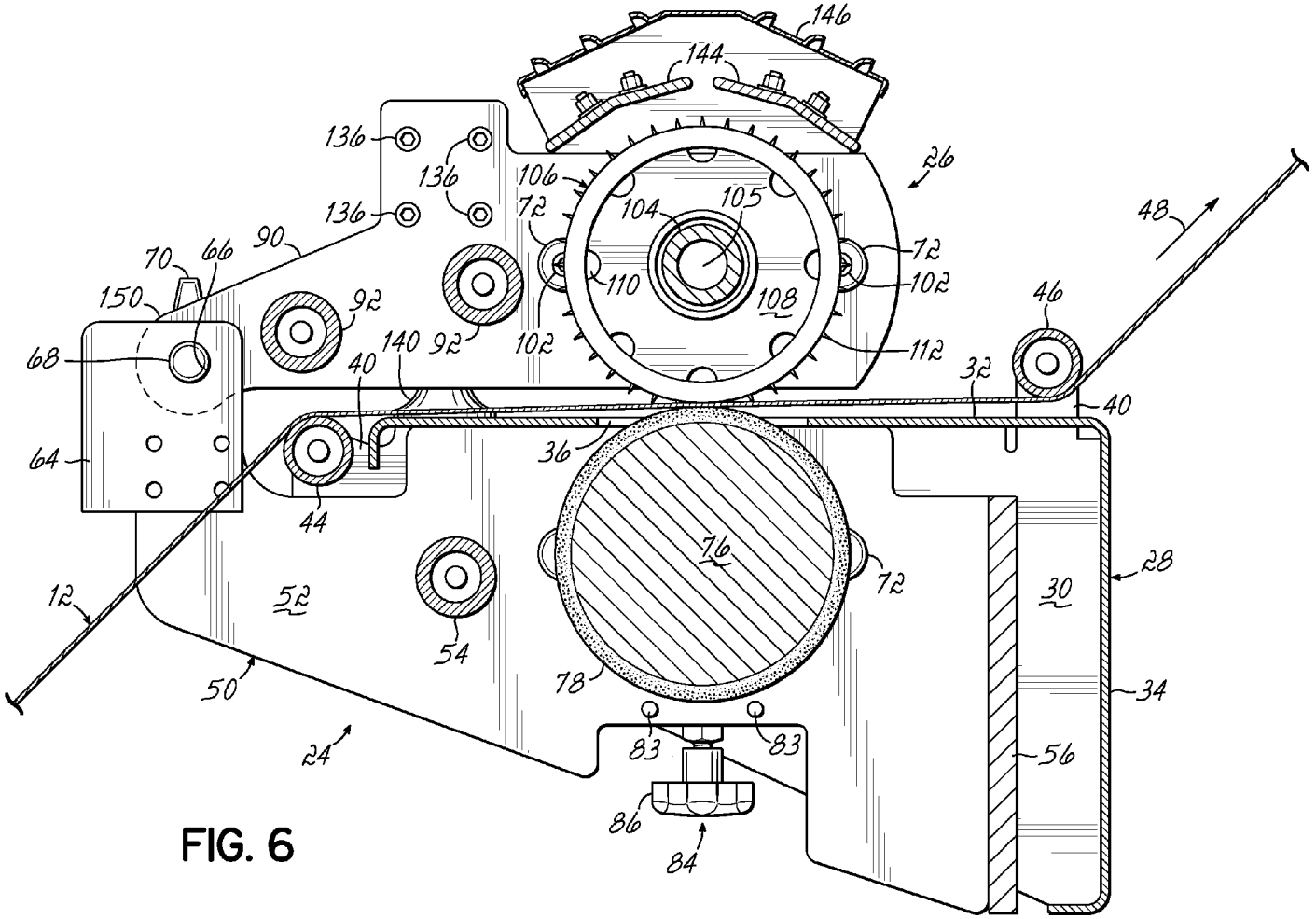
FIG. 6 is a cross-sectional view taken along the line 6-6 of the ventilation apparatus of FIG. 2.

As best illustrated in FIGS. 3 and 4, the stationary portion 24 of the ventilation apparatus 10 comprises an outer frame 28 having two side portions 30, a top portion 32 and a rear portion 34. Although the outer frame 28 is shown as being one piece of metal, it may comprise multiple pieces of metal or plastic or any other desirable material. As best shown in FIG. 3, the top portion 32 of the outer frame 28 has a generally rectangular-shaped opening 36. As best shown in FIG. 3, each side portion 30 of the outer frame 28 has a generally circular-shaped opening 38 (only one being shown) allowing access inside the outer frame 28 for repairs, for example, to repair one of the adjusters 84. As best shown in FIG. 3, each side portion 30 of the outer frame 28 also has a rear tab 40 and a front tab 42. A rotatable front guide roller 44 extends between and is secured to the front tabs 42 on opposed side portions 30 of the outer frame 28. Similarly, a rotatable rear guide roller 46 extends between and is secured to the rear tabs 40 on opposed side portions 30 of the outer frame 28. As shown in FIGS. 4-6, the web of material 12 passes over the rotatable front guide roller 44 and underneath the rotatable rear guide roller 46 as it passes through the ventilation apparatus 10 in the direction of arrow 48 shown in FIG. 1. In some instances, one or both of the guide rollers 44, 46 may be stationary, i.e., non-rotatable.

As best illustrated in FIGS. 3 and 5, the stationary portion 24 of the ventilation apparatus 10 further comprises an inner frame 50 having two side walls 52. As shown in FIGS. 3 and 5, a front brace 54 extends between the side walls 52 and is secured thereto with fasteners 55 (only one being shown). Although the front brace 54 is illustrated as being cylindrical, it may be other desired shapes, such as a short wall. As shown in FIG. 5, a rear wall 56 extends between the side walls 52 and is secured thereto.

Each side wall 52 of inner frame 50 of brush roller assembly 24 also has a front finger 60 with an opening 62 therethrough. As best shown in FIGS. 4 and 5, a bracket 64 having an opening 66 is mounted to the front finger 60 of each side wall 52 of the inner frame 50 with four fasteners 61 for purposes of receiving and retaining a quick release pin 68 having a handle 70. Each of the two pins 68 extends through the aligned openings 60, 66, respectively, upon assembly of the movable portion 26 to the stationary portion 24 of the ventilation apparatus 10.

Figure 3A:
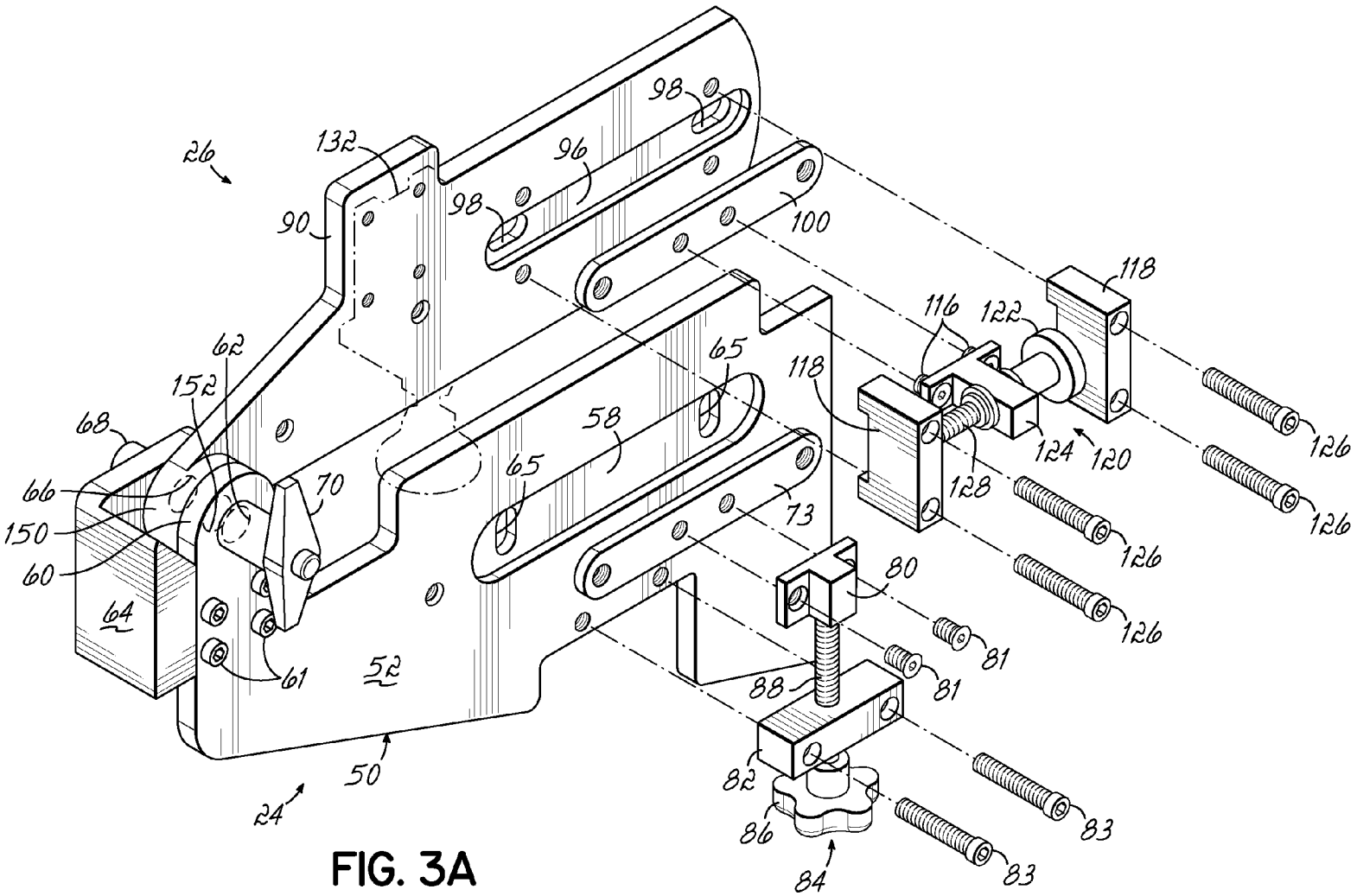
FIG. 3A is another partially disassembled view of the ventilation apparatus of FIG. 1.

As best shown in FIG. 3A, each side wall 52 of inner frame 50 of brush roller assembly 24 has an obround or oval-shaped indentation 58 (only one being shown) which extends only partially through the thickness of the side wall 52. As best shown in FIG. 3A, inside the indentation 58, two obround or oval-shaped openings 65 each extend through the entire thickness of the side wall 52 of inner frame 50.

As best seen in FIGS. 3 and 5, a bearing assembly 72 is mounted to a bearing plate 73 with two bearing bolts 74. The bearing plate 73 is located inside the oval-shaped indentation 58 upon assembly by bearing bolts 74. Each of the two bearing bolts 74 passes through one of the oval-shaped openings 65 inside the obround or oval-shaped indentation 58 and secures the bearing plate 73 located outside the side wall 52 (but inside indentation 58) to a flange of one of the bearing assemblies 72 located inside the side wall 52, as shown in FIG. 3. A brush roller shaft 76 extends between the two bearing assemblies 72 and is rotatably supported by such bearing assemblies 72. A brush roller 78 is supported by the brush roller shaft 76. The brush roller 78 may have nylon bristles. As shown in FIGS. 4-6, an upper portion of the brush roller 78 extends through the opening 36 in the top portion 32 of the outer frame 28 of the brush roller assembly 24 of the ventilation apparatus 10. Although one brush roller is illustrated in the brush roller assembly 24, more than one brush roller may be mounted on a brush roller shaft and extend partially through one or more openings in the outer frame of the brush roller assembly 24 of the ventilation apparatus 10.

As best shown in FIGS. 3A and 5, an adjuster bracket 80 is secured to an outside surface of each bearing plate 73 with two fasteners 81. As shown in FIGS. 3A and 5, a guide bracket 82 is mounted to the side wall 52 of the inner frame 50 of the brush roller assembly 24 of the ventilation apparatus 10 with fasteners 83. The guide bracket 82 is located outside the side wall 52. An adjuster 84 comprising a knob 86 and a threaded rod 88 extending upwardly from the knob 86 adjusts the vertical position or height of one side of the brush roller shaft 76 and brush roller 78 upon rotation of the adjuster 84. As shown in FIGS. 3A and 5, the threaded rod 88 extends through the guide bracket 82 and terminates in the adjuster bracket 80. Rotation of knob 86 and threaded rod 88 causes the adjuster bracket 80 to move vertically and therefore raise or lower the bearing plate 73. As shown in FIGS. 3 and 3A, vertical movement of the bearing plate 73 causes vertical movement of the bearing bolts 74 inside the oval-shaped or obround openings 65 and vertically moves the bearing assembly 72 and, therefore, one side of the brush roller shaft 76. In order to raise or lower the other side of the brush roller shaft 76, the other knob 86 must be rotated the same direction. Rotation of one or the other knobs 86 raises or lowers one end of the brush roller 78 and thereby may be used to adjust or straighten the path of the web 12 moving through the ventilation apparatus 10.

As best illustrated in FIGS. 3 and 4, the movable pin roller assembly 26 of the ventilation apparatus 10 comprises two side walls 90 joined together with two stationary support members 92. Although each of the support members 92 is shown as being generally cylindrical, it may be other shapes or sizes. Although two support members 92 are shown, any number of support members may be used. As shown in FIGS. 5 and 8, each of the support members 92 extends between the side walls 90 and is secured thereto with fasteners 94 (only one side being shown).

As best shown in FIG. 3, at the front of each side wall 90 of the movable pin roller assembly 26 of the ventilation apparatus 10 is a hub 150 which has an opening 152 extending through the hub 150. As best shown in FIG. 3A, when assembled, each of the two hubs 150 is located between one of the brackets 64 and one of the fingers 60 of one of the side walls 52 of the inner frame 50 of the brush roller assembly 24. Each of the two quick release pins 68 having a handle 70 extends through the aligned openings 60, 66 and 152 of the brush roller assembly 24 and movable pin roller assembly 26 of the ventilation apparatus 10, respectively, upon assembly of the ventilation apparatus 10. In an assembled position, the movable pin roller assembly 26 is pivotally secured to the brush roller assembly 24 of the ventilation apparatus 10 along axis "A" shown in FIG. 3.

As shown in FIGS. 3A, 4 and 5, each of the side walls 90 of the movable pin roller assembly 26 has an obround or oval-shaped indentation 96 (only one being shown) which extends only partially through the thickness of the side wall 90. As best shown in FIGS. 3A, 4 and 5, inside the obround or oval-shaped indentation 96, two obround or oval-shaped openings 98 each extend through the entire thickness of the side wall 90.

As best seen in FIGS. 3 and 5, a bearing assembly 72 is mounted to an adjuster plate 100 with two bearing bolts 102. As shown in FIG. 3A, the adjuster plate 100 is located inside the obround or oval-shaped indentation 96 upon assembly by bearing bolts 102. Each of the two bearing bolts 102 passes through one of the oval-shaped openings 98 inside the oval-shaped indentation 96 and secures the adjuster plate 100 located outside the side wall 90 (but inside indentation 96) to a flange of one of the bearing assemblies 72 located inside the side wall 90 of movable pin roller assembly 26, as shown in FIG. 3. A pin roller shaft 104 having a hollow interior 105 extends between the two bearing assemblies 72 and is rotatably supported by such bearing assemblies 72. Two spaced pin rollers 106 are each supported by the pin roller shaft 104. Although the drawings show two spaced pin rollers 106, any number of pin rollers may be used, including a single pin roller.

As best shown in FIG. 6, each pin roller 106 comprises a roller hub 108 having cooling grooves 110 to keep heat absorption to a minimum. As shown in FIGS. 4-6, each pin roller 106 has a plurality of metal pins 112 for imparting openings through the fabric 12 upon rotation of the pin rollers 106. The pins 112 mesh with the upper portion of the brush roller 78 extending through the opening 36 in the top portion 32 of the outer frame 28 of the brush roller assembly 24 of the ventilation apparatus 10. The pins 112 may be in any desired pattern and are not intended to be limited by the drawings.

Figure 7:
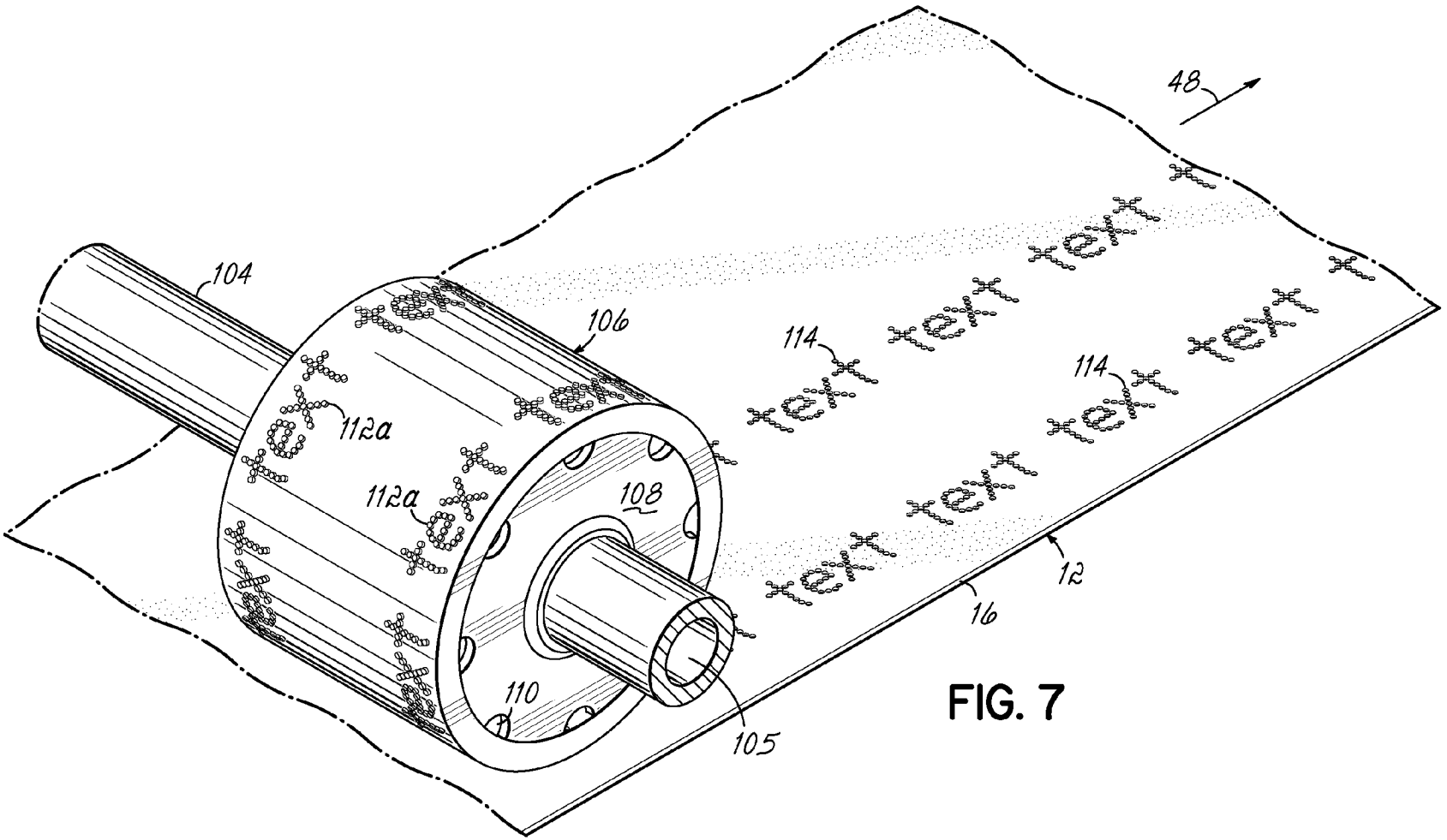
FIG. 7 is a schematic view of one of the rollers of the ventilation apparatus placing letters through the fabric.

As shown in FIG. 7, the pins, 112, 112*a* extending outwardly from one or more of the pin rollers may have a predetermined pattern including, but not limited to, a format of letters and/or numbers or a combination thereof. After the pins 112*a* punch through the web of fabric 12, one or more words and/or symbols 114 may be imparted through the web of fabric 12. The words and/or symbols 114 may be used to identify the source or manufacturer of the pocketed spring product produced using the web of fabric. Alternatively, or additionally, the words and/or symbols 114 may be used to identify the resultant pocketed spring product.

As best shown in FIGS. 3 and 5, a pin roller adjuster 120 is located on each side of the movable pin roller assembly 26 of the ventilation apparatus 10 (only one being shown). Each pin roller adjuster 120 functions to adjust or move one side of the pin roller shaft 104 by rotating a turning wheel 122. As best shown in FIG. 3A, each pin wheel adjuster 120 comprises an adjuster bracket 124 fixedly secured to an outside surface of adjuster plate 100 with two fasteners 116, such that movement of the adjuster bracket 124 moves the adjuster plate 100. As shown in FIGS. 3A and 5, two support brackets 118 supporting the ends of a threaded rod 128 are mounted to the side wall 90 with fasteners 126. The support brackets 118 are fixed in a stationary position outside the side wall 90. The pin roller adjuster 120 comprising turning wheel 122 and a threaded rod 128 adjusts the horizontal position of the pin roller shaft 104 and pin rollers 106 upon rotation of the turning wheel 122. As shown in FIG. 5, the threaded rod 128 extends through the adjuster bracket 124. Rotation of turning wheel 122 and threaded rod 128 causes the adjuster bracket 124 to move horizontally and, therefore, move horizontally the adjuster plate 100 to which the bearing assembly 72 is attached. Horizontal movement of the adjuster plate 100 causes horizontal movement of the bearing bolts 102 inside the oval-shaped openings 98 and horizontally moves the bearing assembly 72 and, therefore, one side of the pin roller shaft 104. In order to move the other side of the pin roller shaft 104, the other turning wheel 122 must be rotated the same direction. Rotation of one or the other turning wheels 122 moves one end of the pin roller shaft 104, and thereby may be used to straighten the path of the web 12 moving through the ventilation apparatus 10.

As best illustrated in FIGS. 3 and 4, the movable portion 26 of the ventilation apparatus 10 further comprises a fabric adjuster 132. The fabric adjuster 132 moves the position of the web of fabric 12 moving through the ventilation apparatus 10 in order to adjust the pin depth as the pins extend through the fabric. Each fabric adjuster 132 comprises a lift cylinder 134 secured to one of the side walls 90 with four fasteners 136. The fabric adjuster 132 further comprises a threaded rod 138 movable inside the lift cylinder 134 and terminating in a foot 140 which contacts the moving web of fabric 12. See FIGS. 3 and 4. By rotating the threaded rod 138 manually with a turner 142, an operator may adjust the height of one or both fabric adjusters 132. Alternatively, lift adjusters 132 may automatically raise the movable portion 26 of the ventilation apparatus 10 in the event of a stoppage of the fabric web 12.

As best illustrated in FIGS. 3 and 6, the movable portion 26 of the ventilation apparatus 10 further comprises radiant heaters 144 and a heat shield 146.

As shown in FIG. 8, one advantage of the present invention is that the movable portion 26 of the ventilation apparatus 10 may be pivoted to its open position in order to splice or secure a tail edge of one empty roll of fabric to a leading edge of another full roll of fabric.

Figure 9:
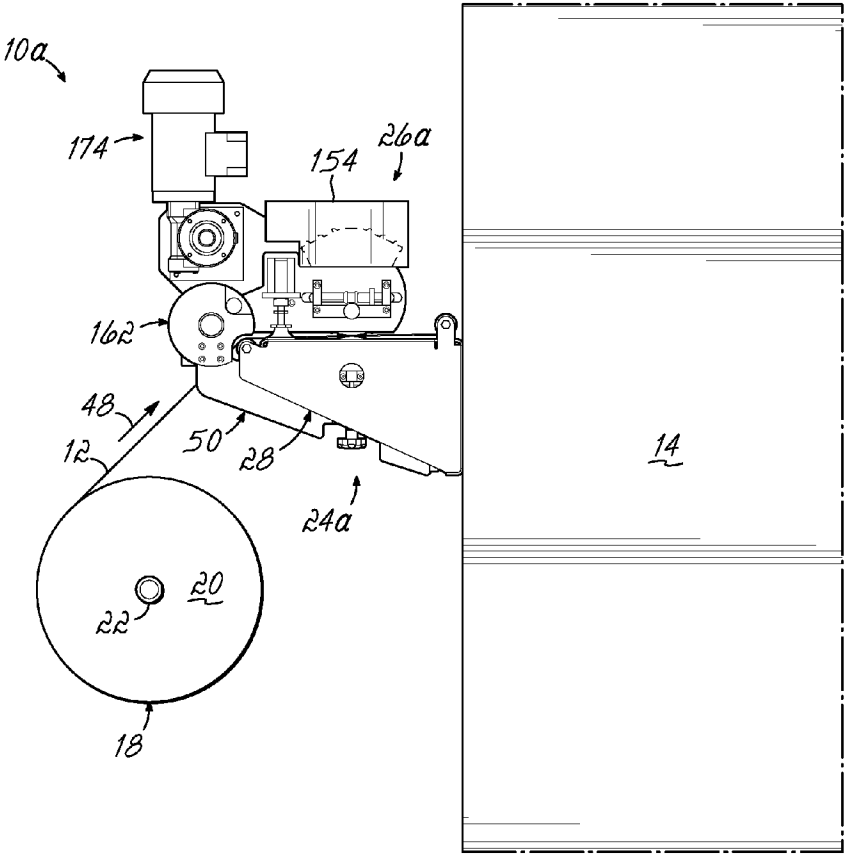
FIG. 9 is a side elevational view of another embodiment of ventilation apparatus according to the invention attached to a pocket coil machine and being utilized to ventilate the fabric used in the pocket coil machine.

FIGS. 9-16 illustrate ventilation apparatus 10*a* used for ventilating a web of material 12, according to another embodiment of this invention. As shown in FIG. 9, the ventilation apparatus 10*a* is attached to a pocket coil machine 14. The ventilation apparatus 10*a* may be attached to any pocket coil machine, including one sold by Spuhl AG and sold as Model P-450. However, the ventilation apparatus 10*a* may be used with any pocket coil machine and does not have to be directly attached to the pocket coil machine. This document does not intend to limit in any fashion the type of pocket coil machine with which the ventilation apparatus 10*a* may be used.

Figure 13:
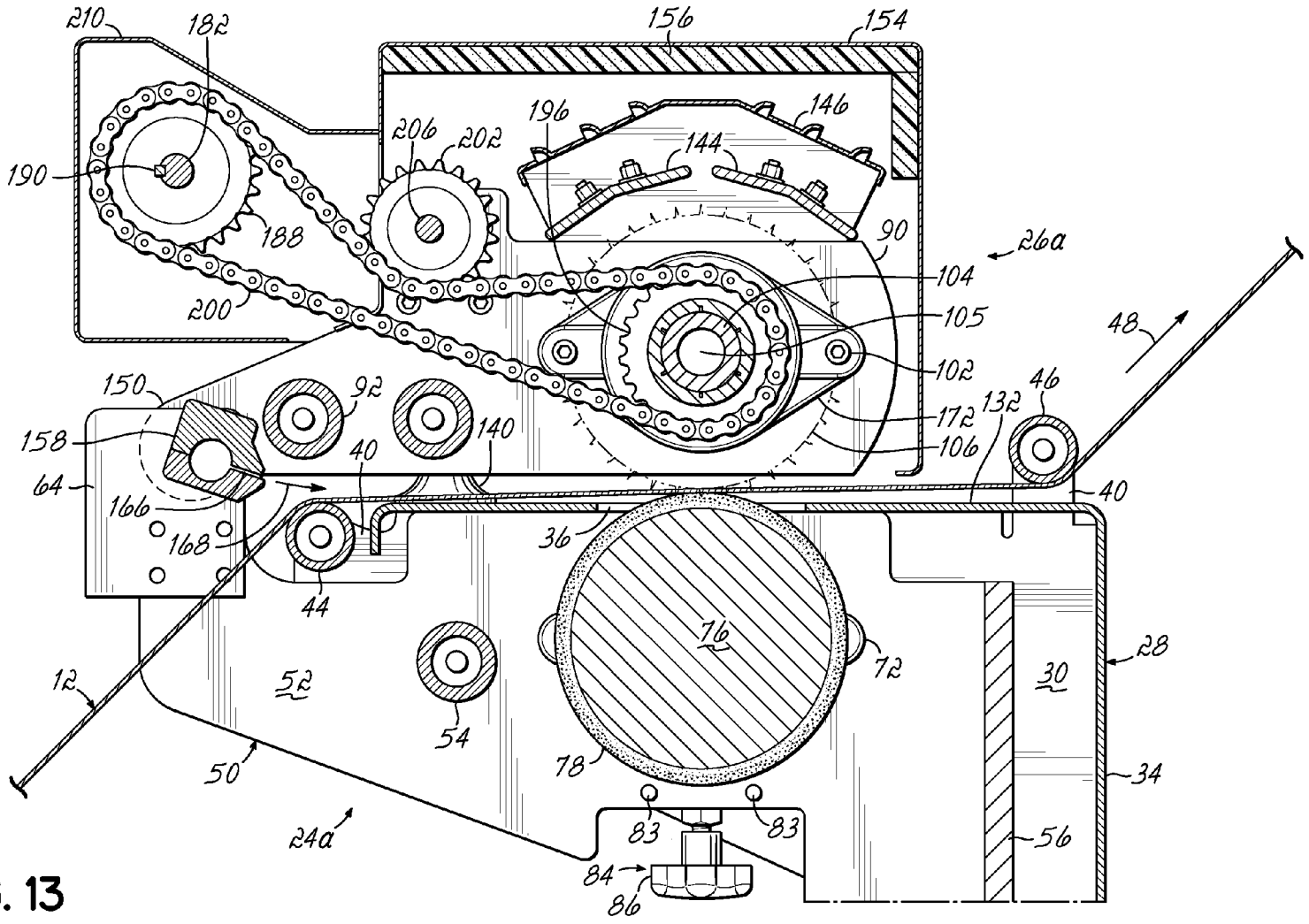
FIG. 13 is a cross-sectional view of the ventilation apparatus of FIG. 9.
Figure 15:
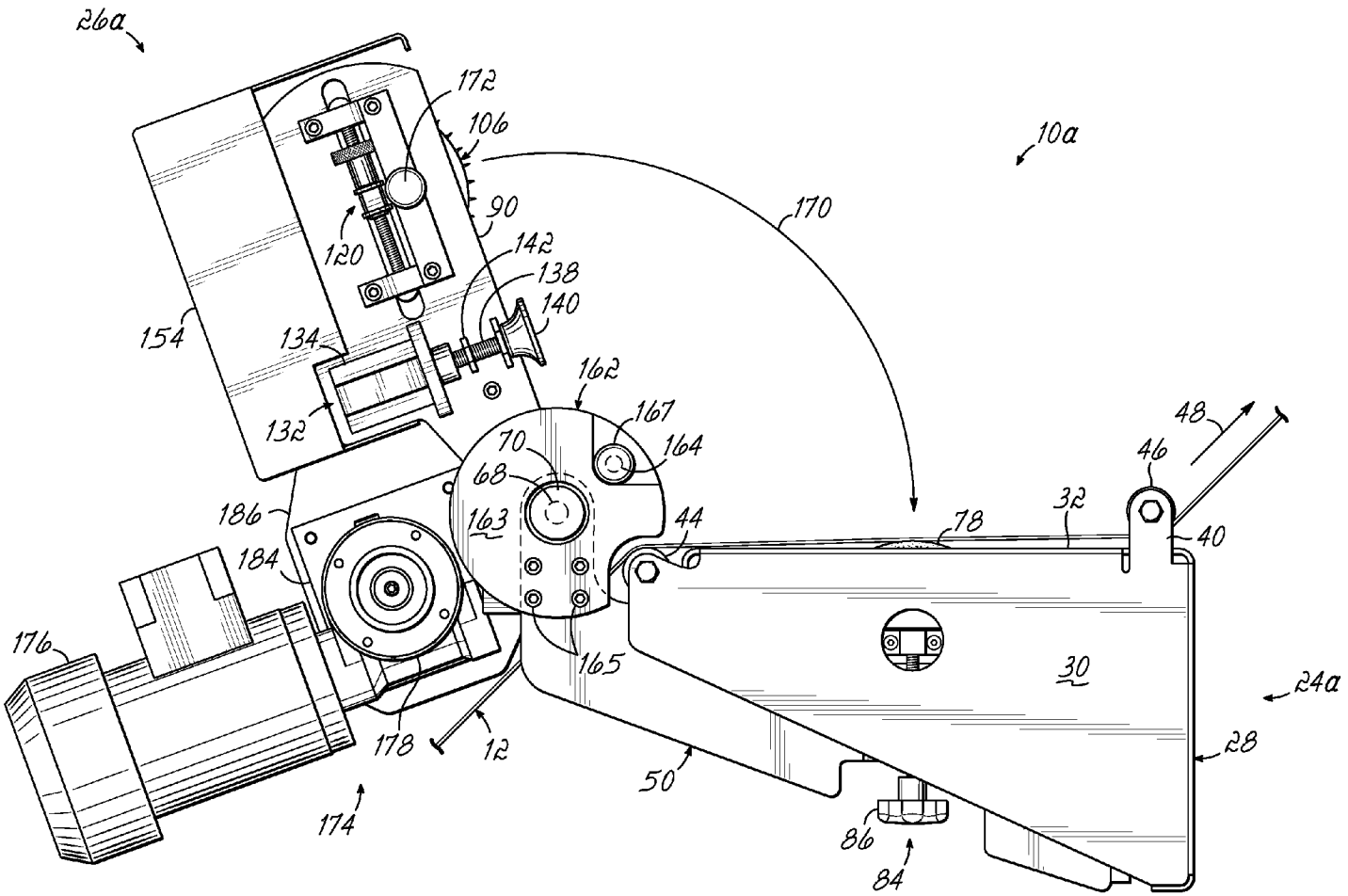
FIG. 15 is a side elevational view illustrating the ventilation apparatus of FIG. 9 in a fully open position.
Figure 16:
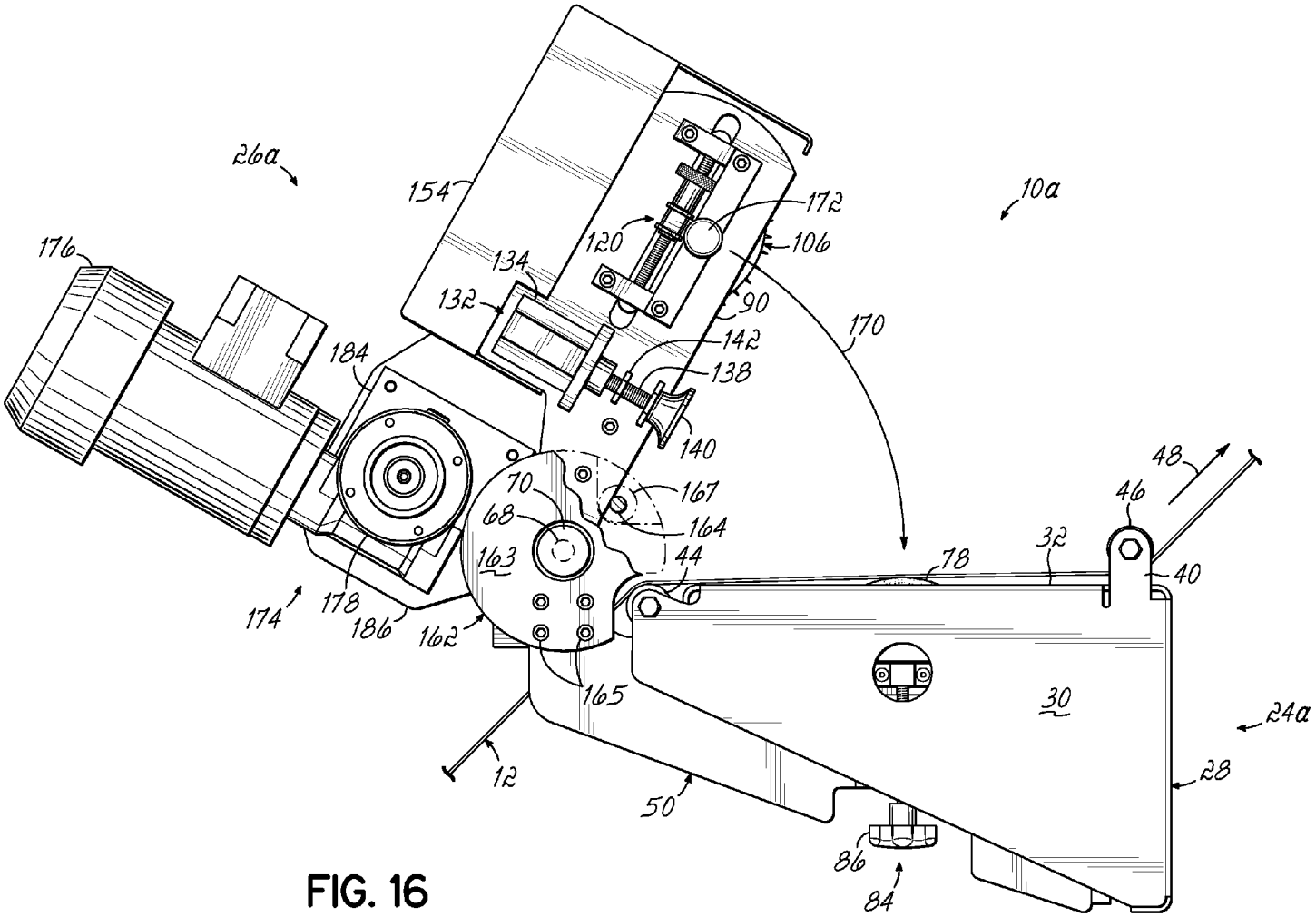
FIG. 16 is a side elevational view illustrating the ventilation apparatus of FIG. 9 in a partially open position.

As best shown in FIG. 13, the ventilating apparatus 10*a* has a stationary portion or brush roller assembly 24*a* and a movable portion or pin roller assembly 26*a* which is pivotal between a fully closed position shown in FIG. 9 and a fully open position shown in FIG. 15. The stationary portion 24*a* of the ventilating apparatus 10*a* is similar to the stationary portion 24 of the ventilating apparatus 10 as shown in FIGS. 1-8 and described herein, but not identical. Ventilating apparatus 10*a* may be removably attached to the pocket coil machine 14, as shown in FIG. 9, or stand on its own a distance from a pocket coil machine.

Figure 10:
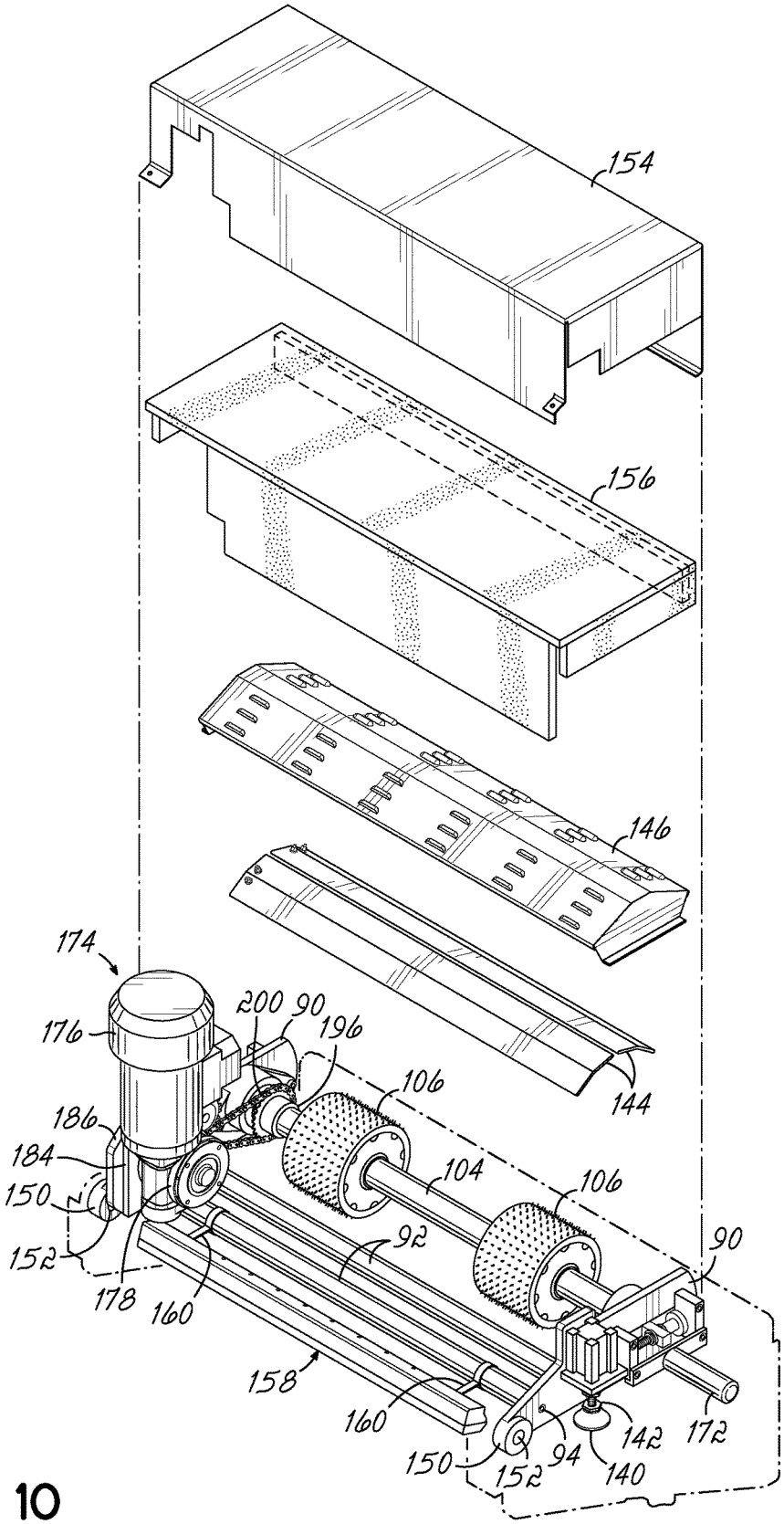
FIG. 10 is a partially disassembled view of the movable portion of the ventilation apparatus of FIG. 9.
Figure 14:
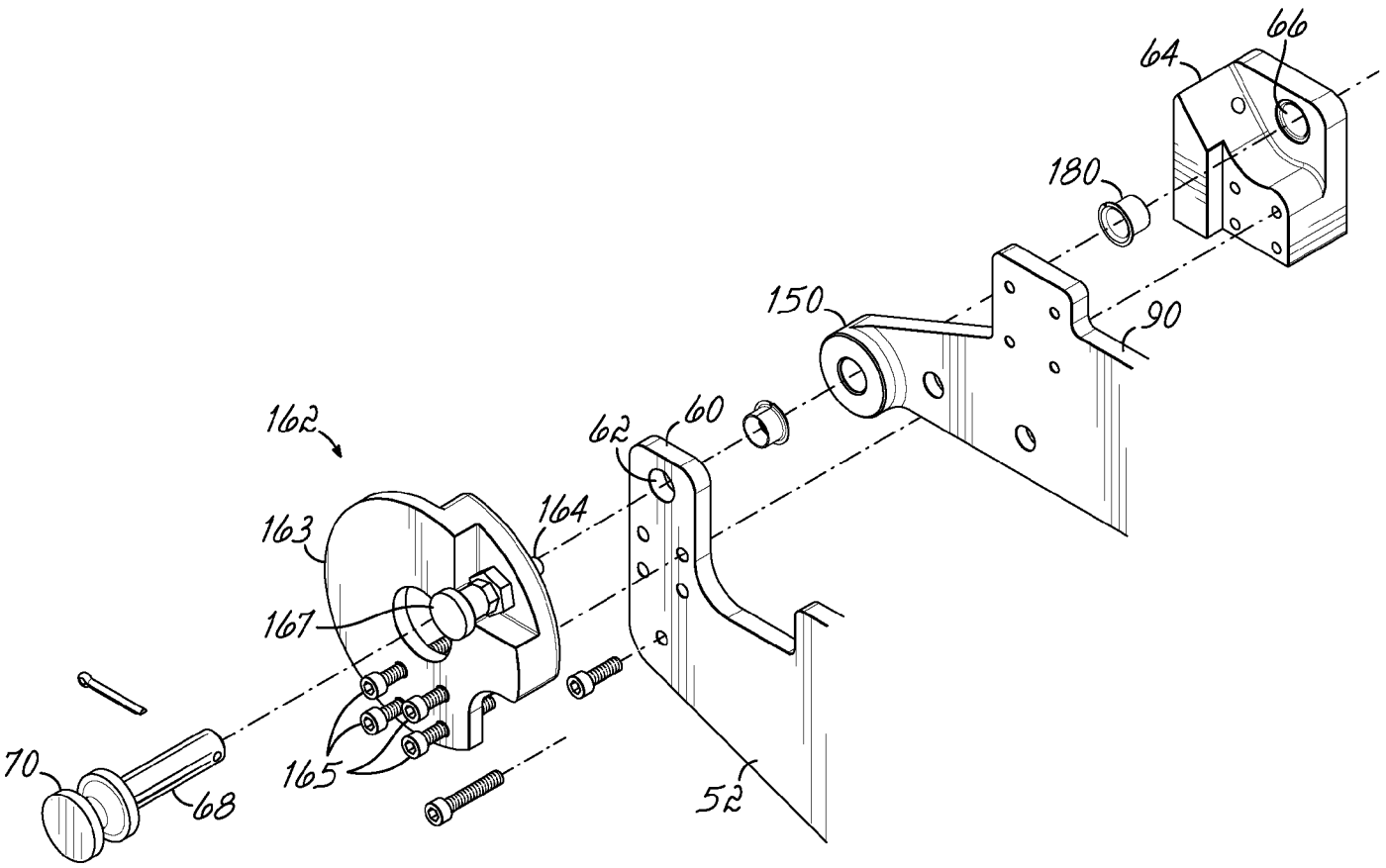
FIG. 14 is a partially disassembled view of a portion of the ventilation apparatus of FIG. 9.

As best shown in FIG. 14, a safety assembly 162 is included in the stationary portion 24*a* of the ventilating apparatus 10*a* on the right side when looking from the front as shown in FIG. 10. As shown in FIG. 14, safety assembly 162 comprises a lock plate 163 mounted outside one of the side walls 52 of inner frame 50 with four fasteners 165 (the right side wall 52 when looking from the front as shown in FIG. 3). The stationary portion 24*a* of the ventilating apparatus 10*a* also has a front finger 60 with an opening 62 therethrough in each side wall 52. As best shown in FIG. 14, a bracket 64 having an opening 66 is mounted to the front finger 60 of each side wall 52 of the inner frame 50. The safety assembly 162 further comprises a spring-loaded safety pin 164 having a knob 167. The spring-loaded safety pin 164 passes through the lock plate 163 and contacts one of the side walls 90 (the right one) of the movable pin roller assembly 26*a*. See FIG. 14. When the pivotal pin roller assembly 26*a* is in its fully open position shown in FIG. 15, the safety pin 164 extends further outwardly because it is no longer stopped by the side wall 90 of the movable pin roller assembly 26*a*.

The safety assembly 162 prevents the movable portion 26*a* of the ventilating apparatus 10*a* from unintentionally fully closing and potentially injuring an operator. Instead, the movable portion 26*a* of the ventilating apparatus 10*a* stops in a partially closed or intermediate position shown in FIG. 16. An operator must pull out safety pin 164 to enable the movable portion 26*a* of the ventilating apparatus 10*a* to move to a fully closed position shown in FIG. 9. When an operator closes the movable portion 26*a* of the ventilating apparatus 10*a* from a fully open position shown in FIG. 15 in the direction of arrow 170 (clockwise as shown in FIG. 15), a portion of the movable portion 26*a* of the ventilating apparatus 10*a* contacts a safety pin 164 of the safety assembly 162, thereby preventing full closure of the ventilating apparatus 10*a*. With the safety pin 164 in its position shown in FIG. 16 abutting a portion of the movable portion 26*a* of the ventilating apparatus 10*a*, an operator may pull outwardly on a knob 167 of the movable pin 164, thereby moving the pin 164 out of the way and allowing the movable portion 26*a* of the ventilating apparatus 10*a* to fully close. A user may move the movable portion 26*a* of the ventilating apparatus 10*a* by grasping a handle 172, best shown in FIG. 10.

As best illustrated in FIGS. 9-16, the movable portion 26*a* of the ventilation apparatus 10*a* comprises some of the same components as movable portion 26 of ventilation apparatus 10 described herein, but further comprises additional components described below. For simplicity, like numbers represent like parts.

As best shown in FIG. 10, the movable portion 26*a* of the ventilation apparatus 10*a* further comprises an outer heat shield 154 and an insulator box 156 inside the outer heat shield 154. The purpose of the insulator box 156 is to keep heat radiating from the radiant heaters 144 from making the outer heat shield 154 too hot so as to be dangerous to the touch. With the insulator box 156, an operator may touch the outer heat shield 154 without getting burned. In other words, the outer heat shield 154 and an insulator box 156 are for safety purposes.

Figure 12:
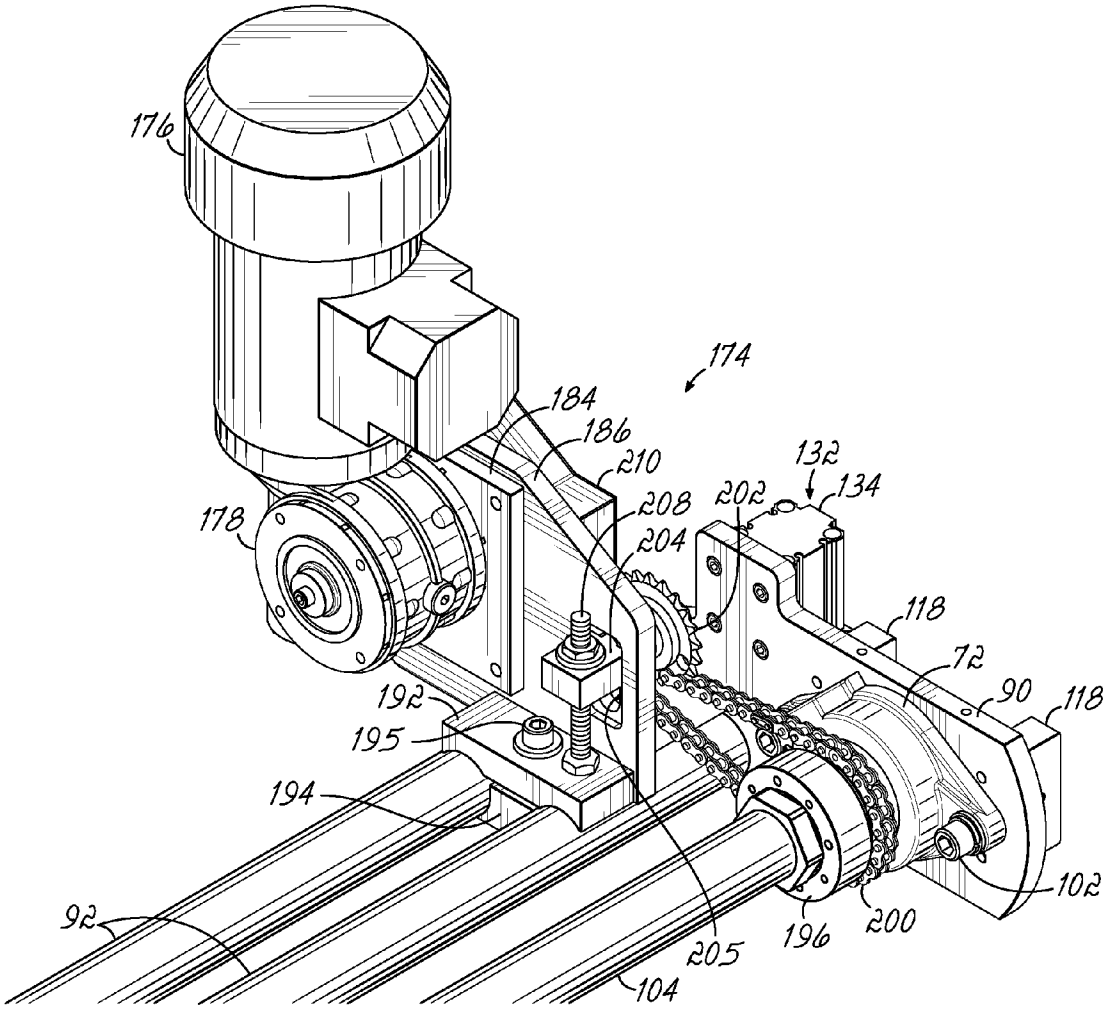
FIG. 12 is an assembled view of a portion of the ventilation apparatus of FIG. 9.

As best shown in FIGS. 10 and 12, the movable portion 26*a* of the ventilation apparatus 10*a* further comprises an air cooling assembly 158 secured with brackets 160 surrounding one of the stationary support members 92. The air cooling assembly 158 functions to create an air barrier between the pin roller and the fabric. In the event of stoppage of the flow of the web 12, the lifts 134 raise the movable portion 26*a* of the ventilation apparatus 10*a* and air flows out of a slot 166 in the air cooling assembly 158 in the direction of arrow 168, as shown in FIG. 13.

As shown in FIGS. 10-13, a drive assembly 174 is included in the movable portion 26*a* of the ventilating apparatus 10*a* on the left side when looking from the front, as shown in FIG. 10. The drive assembly 174 includes a motor 176 which, via a gear box 178, rotates a drive shaft 182. The drive shaft 182 passes through an adaptor plate 184, a motor mount 186 and into a drive sprocket 188. The drive shaft 182 is secured in place so as to rotate the drive sprocket 188 via use of a key 190. As shown in FIG. 12, upper and lower clamp pieces 192, 194, respectively, may be secured to the motor mount 186 and to each other via fastener 195, held in place on the stationary support members 92.

Figure 11:
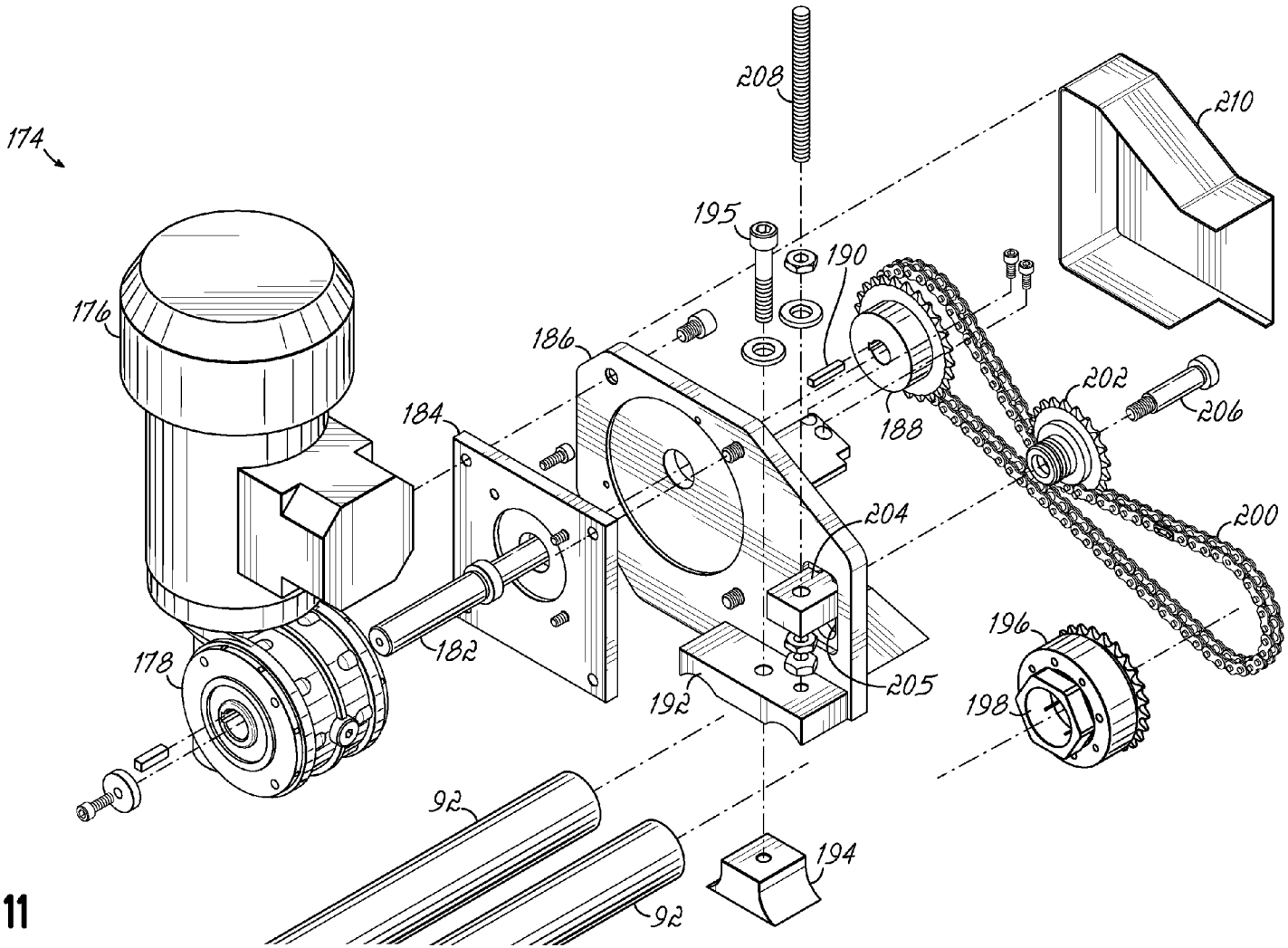
FIG. 11 is a partially disassembled view of a portion of the ventilation apparatus of FIG. 9.

The drive assembly 174 of the pin roller assembly 26*a* further comprises a driven sprocket 196 having a central opening 198 therein through which pin roller shaft 104 passes, as shown in FIG. 12. As best shown in FIG. 11, a chain 200 wraps around the drive sprocket 188 and around the driven sprocket 196. The drive assembly 174 of the pin roller assembly 26*a* further comprises an idler sprocket 202 mounted to an idler bracket 204 via a shoulder bolt 206. As best shown in FIG. 12, the idler bracket 204 and attached idler sprocket 202 may be vertically adjusted inside an opening 205 in the motor mount 186 by rotation of a tension bolt 208. A chain guard 210 protects the drive sprocket 188 and chain 200 from damage.

In operation, activation of the motor 176 rotates the drive sprocket 188 which, via the chain 200, rotates the driven sprocket 196, which rotates the pin roller shaft 104 and pin rollers 106 mounted on the pin roller shaft 104.

One of ordinary skill in the art will readily recognize that the alternative embodiments of the apparatus shown herein are exemplary only of a wide variety of alternative configurations that are readily possible within the scope of this invention.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A method of making a continuous string of pocketed springs, said method comprising:

providing a pocket coil machine;

providing a ventilation apparatus, the ventilation apparatus having a first portion secured to the pocket coil machine and a second portion pivotal relative to the first portion to allow access inside the ventilation apparatus;

passing a web of material between two rollers, one of the rollers being mounted in the first portion of the ventilation apparatus and the other roller being rotatably mounted in the second portion of the ventilation apparatus, at least one of the rollers having protrusions to create a patterned web, the patterned web having openings extending through the web; and introducing the patterned web into the pocket coil machine for creating a string of individually pocketed springs.

2. The method of claim 1 wherein creating the patterned web comprises passing the web of material between a brush roller and at least one pin roller.

3. The method of claim 1 further comprising adjusting the position of the web of material by a fabric adjuster.

4. The method of claim 1 further comprising adjusting the position of the web of material passing through the ventilation apparatus to adjust pin depth of pins passing through the web of material.

5. The method of claim 1 wherein passing the web of material between two rollers comprises passing the web of material between a brush roller and one of the rollers having protrusions.

6. The method of claim 1 further comprising adjusting at least one of the rollers.

7. The method of claim 1 further comprising heating at least one of the rollers having protrusions.

8. The method of claim 1 further comprising adjusting at least one of the rollers.

9. The method of claim 1 further comprising heating at least one of the rollers.

10. A method of making a continuous string of pocketed springs, said method comprising:

providing a pocket coil machine;

providing a ventilation apparatus having a stationary portion secured to the pocket coil machine and a movable portion movable relative to the stationary portion to allow access inside the ventilation apparatus;

passing a web of material through the ventilation apparatus, the web of material passing between rollers to create a patterned web, at least one of the rollers having pins and at least one of the rollers being a brush roller, the patterned web having openings through the web; and introducing the patterned web into the pocket coil machine for creating a string of individually pocketed springs.

11. The method of claim 10 wherein the brush roller is supported by a brush roller shaft extending between bearing assemblies in the stationary portion of the ventilation apparatus.

12. The method of claim 10 wherein the the web of material is passed between a brush roller and at least one pin roller to create the patterned web.

13. The method of claim 10 further comprising adjusting the position of the web of material passing through the ventilation apparatus to adjust pin depth of pins passing through the web of material.

14. A method of making a continuous string of pocketed springs, said method comprising:

providing a pocket coil machine;

providing a ventilation apparatus comprising a brush roller assembly supporting a brush roller and a pin roller assembly, the brush roller assembly being attached to the pocket coil machine, the pin roller assembly being movable relative to the brush roller assembly, the pin roller assembly comprising at least one pin roller mounted on a pin roller shaft, the pin roller shaft extending between bearing assemblies of the pin roller assembly;

passing a web of material between the brush roller assembly and the pin roller assembly to create a patterned web having openings extending through the patterned web;

introducing the patterned web into the pocket coil machine for creating a string of individually pocketed springs.

15. The method of claim 14 further comprising adjusting the web of material to adjust pin depth of pins passing through the web of material.

16. The method of claim 14 further comprising heating the web of material.

17. The method of claim 14 further comprising heating the web of material with a heater which moves with the pin roller assembly.

18. The method of claim 14 further comprising adjusting at least one of the rollers.

19. The method of claim 14 wherein the pin roller assembly is pivotal relative to the brush roller assembly.

* * * * *